United States Patent [19]

Solloway

[11] Patent Number: 4,813,668

[45] Date of Patent: Mar. 21, 1989

[54] AQUATIC BOOT

[76] Inventor: Daniel S. Solloway, 11121 Ashford Dr., Yukon, Okla. 73099

[21] Appl. No.: 78,781

[22] Filed: Jul. 28, 1987

[51] Int. Cl.[4] ..... A63B 21/00

[52] U.S. Cl. ..... 272/116; 272/71; 441/60; 36/105

[58] Field of Search ..... 272/71, 96, 116, 119; 441/59-64; 2/22; 36/8.1, 105, 116; 434/254

[56] References Cited

U.S. PATENT DOCUMENTS

| | | | |
|---|---|---|---|
| 1,636,316 | 7/1927 | Noesske | 441/60 |
| 2,792,577 | 5/1957 | Boyers | 441/60 |
| 2,898,611 | 8/1959 | Mooney | 441/60 |
| 3,671,987 | 6/1972 | Mayor | 441/61 |
| 3,867,734 | 2/1975 | Courageux | 441/64 |
| 4,411,422 | 10/1983 | Solloway | 272/96 |
| 4,624,015 | 11/1986 | Bottoms | 2/22 |
| 4,632,387 | 12/1986 | Guzman | 272/71 X |
| 4,685,226 | 8/1987 | Olivieri et al. | 36/105 X |

FOREIGN PATENT DOCUMENTS

| | | | |
|---|---|---|---|
| 931201 | 6/1982 | U.S.S.R. | 272/71 |

*Primary Examiner*—Richard J. Apley
*Assistant Examiner*—Robert W. Bahr
*Attorney, Agent, or Firm*—Thomas W. Tolpin

[57] ABSTRACT

An aquatic exercise boot is provided for interchangeable and comfortable use by men, women and children alike. The aquatic exercise boot permits a large range of movement and increased resistive forces, torque and torsion. The aquatic exercise boot serves as fluid resistors to water flow as the aquatic boot is moved through the water. The aquatic exercise boot can have a ankle assembly with an expansion joint and pivotable side fins, a leg assembly with a calf-engaging clam shell and an aquatic leg section, and a foot assembly with an aquatic foot section and a curved aquatic sole.

5 Claims, 4 Drawing Sheets

AQUATIC BOOT

BACKGROUND OF THE INVENTION

This invention relates to exercise equipment, and more particularly, to an exercise boot for use in water.

A variety of weight lifting and exercise devices equipment, such as barbells, have been developed over the years. Typifying these weight lifting and exercise equipment and other devices are those shown in U.S. Pat. Nos. 373,692; 654,097; 660,692; 717,041; 1,260,931; 1,366,200; 1,676,689; 2,143,337; 3,260,523; 3,427,022; 3,463,492; 3,671,988; 3,809,397, 3,889,308; 4,029,312; 4,227,273; 4,300,759; 4,411,422; 4,311,306; 4,416,451; 4,458,896; 4,468,023; 4,521,011; 4,627,613; Des. 190,605; Des. 224,935; Des. 495,769; Des. 1,906,056; German Pat. No. 351,627; Italian Pat. No. 615,402; British Pat. No. 8,729; British Pat. No. 13,630; British Pat. No. 495,769; and British Pat. No. 1,041,324. These weight lifting and exercise devices have met with varying degrees of success.

Conventional weight lifting and land exercise equipment, however, are often relatively awkward, cumbersome and complex and are not suitable for interchangeable use by men, women, and older children alike having different physical capabilities and strengths without extensive modifications. For example, barbells, as well as pulley and rope exercise devices have various size weights which usually must be adjusted, such as by adding or removing the weights from the exercise device, to accommodate the exercise device to the particular lifting strength and physical capability of the weight lifter. Furthermore, many of these conventional land exercise devices exert an excess amount of torque and torsion (twist) on the joints of the user and are, therefore, not usually suitable for many types of physical therapy.

It is, therefore, desirable to provide an improved aquatic exercise boot which overcomes most, if not all, of the above disadvantages.

SUMMARY OF THE INVENTION

An improved aquatic exercise boot is provided for use in water to strengthen muscles, improve muscle tone, and enhance muscular coordination. Advantageously, the aquatic boot is readily usable by men, women and children alike, having different strengths and physical capabilities without substantial modification.

The aquatic boot of this invention is particularly useful for physical therapy in water because the torque, torsion and resistant forces which it exerts on the joints of the patient can be readily controlled by the physical therapist, by simply varying the acceleration or momentum of the aquatic exercise assembly to the desired amount. Desirably, the aquatic exercise boot is easy to use and is relatively simple in design and construction for economy of manufacture.

To this end, the aquatic exercise boot has a special aquatic foot assembly, leg assembly, and ankle assembly. The ankle assembly pivotally connects the foot assembly to the leg assembly.

The special foot assembly has an aquatic foot section and a curved, flexible aquatic sole. The aquatic foot section snugly fits over and generally conforms to the top portion of the foot of an exerciser, patient, or other person. The aquatic sole comfortably fits under, supports, and generally conforms to a substantial portion of the bottom (sole) of the person's foot.

The aquatic foot section has at least one fin. Preferably, the aquatic foot section has a water-engageable foot deflector with V-shaped sides and upwardly facing V-shaped pockets to cuppingly and resistively engage the water as the foot section is moved upwardly in the water. In the preferred form, the aquatic foot section has downwardly extending, outer foot fins. The outer foot fins can include lateral foot fins and transverse foot fins. Desirably, the outer foot fins provide downwardly facing foot pockets to cuppingly and resistively engage the water as the aquatic foot assembly is moved downwardly in the water.

The aquatic sole is connected to the bottom portion of the foot section. Desirably, the aquatic sole has a concave bottom and a rounded heel portion. In the preferred form, the aquatic sole has a semi-circular bottom and cooperates with the foot section to provide an open toe portion to accommodate different size feet.

The special leg assembly has an aquatic leg section and a calf-engaging clam shell. The lower portion of the aquatic leg section is pivotally connected to the lower portion of the clam shell to permit the leg assembly to move from a retracted closed position during use in water to an expanded open position to accommodate easier insertion and removal of the leg assembly from the person's leg. The aquatic leg section snugly fits over and generally conforms to the front portion of the person's lower leg. The clam shell comprises an aquatic calf portion which securely fits against and generally conforms to the back (calf) portion of the person's lower leg.

The aquatic leg section has at least one fin. Preferably, the aquatic leg section has a water-engageable leg deflector with V-shaped sides and forwardly facing V-shaped pockets to cuppingly and resistively engage the water as the leg assembly is moved forwardly in the water. In the preferred form, the aquatic leg section has rearwardly extending, outer leg fins. The outer leg fins can include lateral leg fins and transverse leg fins. Desirably, the outer leg fins provide rearwardly facing leg pockets to cuppingly and resistively engage the water as the aquatic leg assembly is moved rearwardly in the water.

In the preferred form, the aquatic leg section has a water-resistive upper arcuate flange which provides a stabilizing fin to enhance the aquatic stability and water resistance of the aquatic leg section. The leg section can also have ribs to enhance the structural strength and rigidity of the leg section.

The calf-engaging clam shell comprises an aquatic calf portion which distributes the aquatic load and pressure exerted by the aquatic boot on the person's calf more uniformly over the entire calf region of the person's leg than the use of calf straps alone to provide a more comfortable, stable and secure fit while minimizing the intensity and concentration of strap forces and pressure on the person's calf. The clam shell is elongated with a rearwardly facing, generally imperforate water-impingement surface to enhance the rearward fluid resistance to water flow as the leg assembly is moved transversely in the water.

The aquatic ankle assembly have pivotable upright ankle fins and a resilient, upwardly facing, water-resistive aquatic expansion joint. The ankle fins are positioned along the sides of the person's ankle. The expansion joint is positioned along the sides of the person's ankle. The expansion joint is positioned above and covers the top of the person's ankle.

The ankle fins slide along the inner surfaces of the aquatic foot section and/or the aquatic leg section. Desirably, the ankle fins provide water-resistant ankle barriers which prevents (block) water from transversely passing between the leg section and the foot section. The ankle fins also increase the transverse fluid resistance as the aquatic boot is moved sideways and transversely in the water.

In the preferred form, the ankle fins have arcuate side portions with pivotable annular ankle discs at their lower ends. The ankle discs can matingly engage complementary discs of the aquatic leg assembly and/or the aquatic foot assembly.

The aquatic expansion joint connects the leg and foot sections and provides an upwardly facing hydrodynamic resistance assembly which blocks downward flow of water between the leg section and the foot section. The aquatic expansion joint also enhances the upward fluid resistance of the ankle assembly as the aquatic boot is moved upwardly in the water. In the preferred form, the expansion joint comprises flexible accordion type hinges.

The fins of the aquatic boot have imperforate and water-impervious portions which provide water-resistive impingement surfaces to hydrodynamically deflect water and create a pressure head and fluid resistance to water flow as the aquatic boot is moved in the water. Each of the fins are positioned an effective distance to exert a hydrodynamic torque on the person's leg, ankle, and foot as the aquatic boot is moved in the water.

While the illustrated aquatic boot is preferred, some persons may desire to use the aquatic foot assembly alone, or the aquatic leg assembly alone, or parts of the aquatic foot, ankle and/or leg assemblies.

As used throughout this application, the term "hydrodynamic resistance" means a fluid resistance exerted on the aquatic exercise boot and user when the aquatic exercise boot is moved in or through the water.

A more detailed explanation of the invention is provided in the following description and appended claims taken in conjunction with the accompanying drawings.

DETAILED DESCRIPTION OF THE PREFERRED EMBODIMENTS

Figure 1:
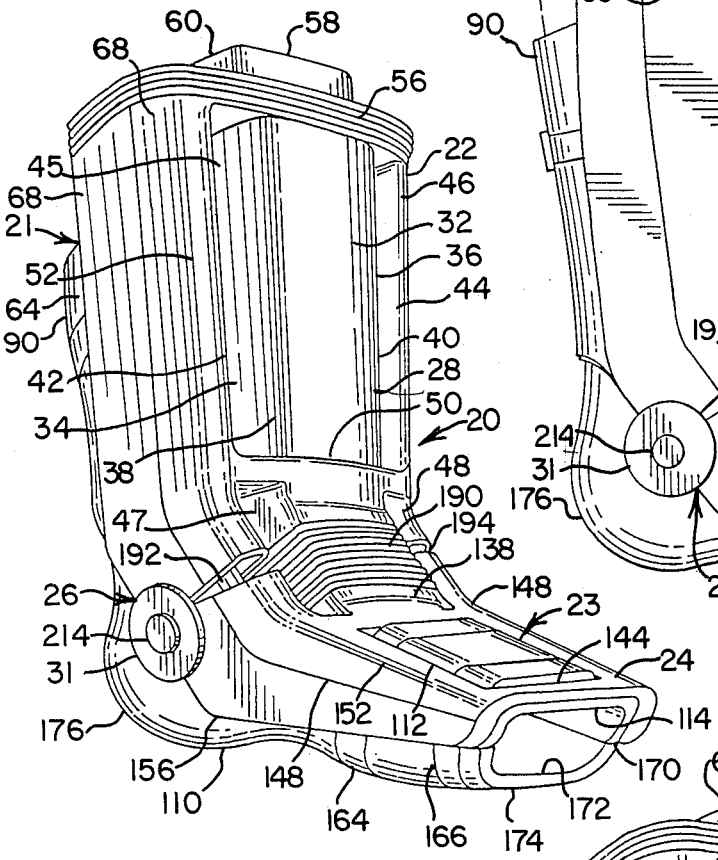
FIG. 1 is a a perspective view of an aquatic boot in accordance with principles of the present invention.

The aquatic leg exercise assembly and exerciser 20 shown in FIGS. 1–7 provides an aquatic exercise boot or hydrodynamic boot which is compact, easy to construct and effective to strengthen muscles, improve muscle tone and enhance muscular coordination. The aquatic boot 20 is also safe, easy to use, and aesthetically pleasing.

The aquatic boot 20 is designed for use in water and is particularly useful for therapy and recovery from leg injuries as well as to develop leg strength for various sports, such as football, soccer, baseball, running, jogging, basketball, tennis, volleyball, pole vaulting, jumping, etc. The aquatic boot 20 is lightweight, comfortable and portable and permits the exerciser (user) or therapist to control the magnitude of the water forces, torque and torsion exerted on the exerciser's leg, ankle and foot, via the aquatic boot 20, while minimizing harsh impact forces and shock. Control can be attained by varying the acceleration and momentum of the aquatic boot 20.

The aquatic boot 20 can be used by men, women and children of various strengths and ability without changing, adding or removing parts. The aquatic boot 20 can come in various sizes and can also be used by patients and paraplegics to recover from leg and foot disabilities and injuries.

The portable aquatic boot 20 can be comfortably used is in water by patients, paraplegics, and athletes, such as football players, baseball players, basketball players, weight lifters, body builders, runners, joggers, tennis players, raquetball players, hockey players, etc. as well as other persons desirous of strengthening their muscles, improving their muscle tone, and enhancing their muscular coordination.

The aquatic exercise assembly 20 is particularly useful to physical therapists because it permits a greater range of motion in the water than conventional ankle weights, leg weights, and many other types of conventional weight lifting and exercise devices that are used on land, such as in gymnasiums. The aquatic exercise boot 20 is helpful to improve the cardiovascular system and general physical well being and strength of the user.

Structurally, the aquatic exercise assembly 20 is formed of a substantially water-impermeable and impact-resistant material, such as lightweight aluminum, impact-resistant plastic, or rubber, or combinations thereof. Other water-impermeable materials can be used.

The aquatic boot 20 has three assemblies or units including an aquatic lower leg assembly 21 with a composite aquatic leg section 22, an aquatic foot assembly and shoe 23 with an aquatic composite foot section 24, and a multi-piece aquatic pivotable ankle assembly and section 26. The aquatic leg section 22 comprises a composite shin portion which snugly engages, fits against, and generally conforms to the front portion or shin of the person's lower leg between the kneecap and ankle. The aquatic foot section 24 provides an aquatic shoe which snugly engages, fits upon, and generally conforms to the top portion of a person's foot. The multi-piece aquatic ankle section and assembly 26 fits about, engages, and is positioned adjacent the person's ankle.

Figure 5:
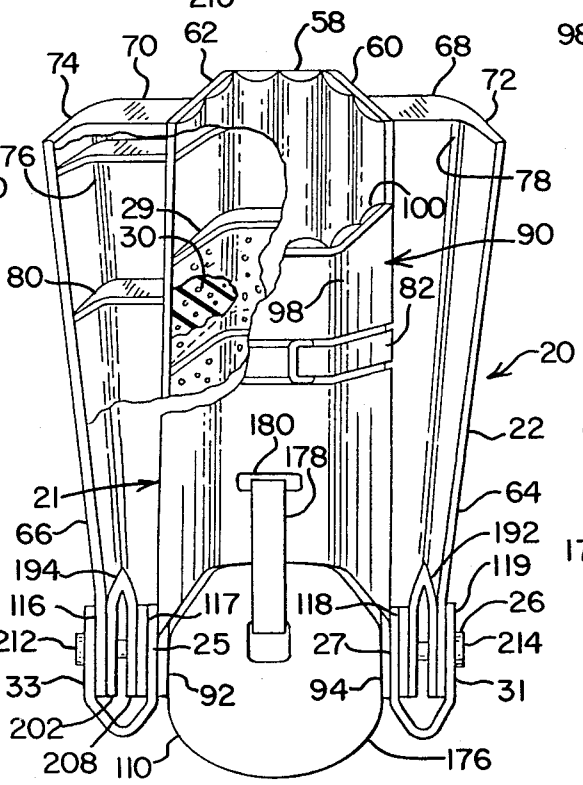
FIG. 5 is a back view of the aquatic boot.
Figure 4:
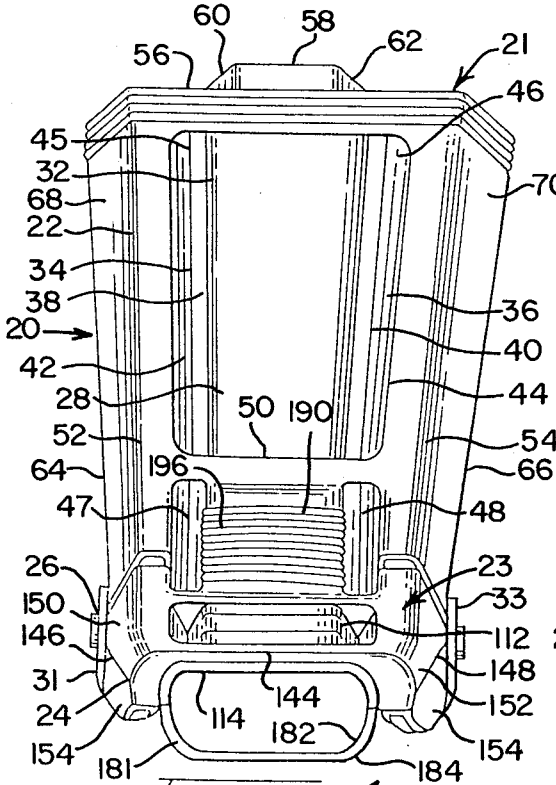
FIG. 4 is a front view of the aquatic boot.

The aquatic leg section 22 has an outer, external, generally U-shaped or channel-shaped, water-engageable shin deflector or baffle 28 with inwardly facing, horizontal arcuate shin ribs 29 (FIG. 5), and has a generally U-shaped or channel-shaped, elastomeric ribbed, inner shin pad (padding) 30 which provides a vibration dampening shin cushion between the shin ribs 29. The left and right (inner and outer) bottom portions of the aquatic leg section 22 includes connectable, pivotable, symmetrical, annular circular leg discs 25, 27, 31, and 33 (FIG. 5). The internal shin pad 30 is made of an elastomeric rubber-like cellular foam material, such as closed cell neoprene rubber, that resiliently conforms to and matingly engages the front (shin) of the person's leg. Other materials can be used.

The shin deflector 28 (FIG. 4) has a generally planar or flat, forwardly facing, front shin face 32, plate or bight and generally V-shaped flared sides 34 and 36 which extend rearwardly from the ends of the front shin face 32. The V-shaped sides 34 and 36 have generally planar or flat inner leg fins 38 and 40 which extend rearwardly and outwardly from the ends of the front shin face 32 at an obtuse angle ranging from about 105 degrees to about 165 degrees, preferably about 120 degrees to about 150 degrees. Generally planar or flat inner shin sides 42 and 44 extend forwardly and outwardly, from the rearward end of the inner leg fins 38 and 40, respectively, at an acute angle ranging from about 30 degrees to about 75 degrees, preferably about 60 degrees, and provide inclined forwardly extending leg fins. The V-shaped sides 34 and 36 provide upper and lower forwardly facing, V-shaped shin pockets 45–48 or cups to cuppingly and resistively engage the water as the aquatic leg section 22 is moved in a forward direction in the water. The V-shaped shin pockets 45–48 are separated by a horizontal transverse, water-resistive, forwardly facing, generally planar or flat, T-shaped front crossbar 50. The front crossbar 50 extends horizontally between and connects the forwardly facing, upwardly diverging, peripheral shin (leg) sides 52 and 54. An upper horizontal stabilizing crossbar 56 extends across the top of the peripheral shin sides 52 and 54. The stabilizing crossbar 56 comprises a corrugated or accordion type member and enhances the forward water resistance and aquatic stability of the leg section 22.

An upper arcuate, U-shaped or channel shaped, water-resistive flange 58 extends above the upper crossbar 56 to enhance the forward fluid resistance to water flow and provide a supplemental forward pressure head as the aquatic leg section 22 is moved forwardly in the water. The aquatic flange 56 has tapered sides 60 and 62. The aquatic flange 58 defines a stabilizing fin to enhance the aquatic stability and fluid resistance of the aquatic leg assembly 21.

Figure 6:
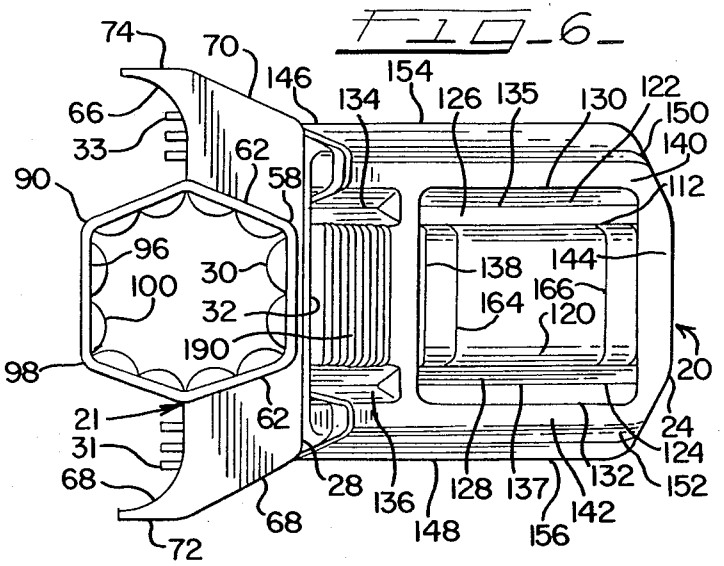
FIG. 6 is a top view of the aquatic boot.

Outer leg fins or wings 64 and 66 extend outwardly and rearwardly of the peripheral sides 52 and 54. The outer leg fins 64 and 66 include inclined lateral leg fins 68 and 70 and transverse leg fins or side fins 72 and 74 (FIGS. 5 and 6). The lateral leg fins 68 and 70 extend rearwardly and outwardly from the ends of the peripheral sides 52 and 54 (FIG. 4) at an obtuse angle ranging from about 105 degrees to about 165 degrees, preferably about 120 degrees to about 150 degrees. The transverse leg fins 72 and 74 (FIG. 5) extend rearwardly at an angle ranging from about 195 degrees to about 265 degrees from the back of the lateral leg fins 68 and 70. The transverse leg fins 72 and 74 are preferably positioned perpendicular or normal to front shin face 32.

The rearwardly facing, back surfaces of the lateral leg fins 68 and 70 cooperate with the rearwardly facing back surfaces of the transverse leg fins 72 and 74, respectively, to define rearwardly facing, arcuate concave, leg pockets 76 and 78 or cups which cuppingly and resistively engage the water as the aquatic leg section 22 is moved rearwardly through the water. The transverse leg fins 72 and 74 also provide water-resistive transverse end portions or side portions and surfaces that resistively engage the water as the aquatic leg section 22 is moved sideways through the water. The lateral leg fins 68 and 70 and the transverse leg fins 72 and 74 can be generally planar or flat. The outer leg fins 64 and 66 can have rearwardly facing, horizontal arcuate ribs 80 (FIG. 5) for enhanced structural strength and rigidity. The transverse side fins 72 and 74 extends laterally outwardly in a sideways direction from the front shin face 32 of the aquatic leg section 22 and are substantially rigid to provide an effective hydrodynamic force, torque and pressure head. The rearward extremities of the transverse leg fins 72 and 74 are aligned with each other. The corners or junction where the leg fins intersect each other or the peripheral shin sides of the shin deflector can be rounded and curved.

The leg fins comprise shin fins which are preferably imperforate. The shin fins provide increased surface area to effectively resist movement through the water. The leg fins provide hydrodynamic resistance shin (leg) assemblies which hydrodynamically deflect water and create a pressure head and fluid resistance to water flow as the aquatic leg section 22 is moved through the water. The leg fins are positioned an effective distance from the front shin face 32 of the shin deflector 28 to exert a hydrodynamic torque on the front shin face 32 and leg to strengthen the muscles of the person's leg.

While the shin deflector 28 and leg fins of the aquatic leg section 22 are preferable shaped and proportioned as shown in the drawings and described above for best results, in some circumstances it may be desirable that the shin deflector and the leg fins be flexible, curved, proportioned differently, at different angular relationships, or of a different shape, or that more or less fins be used. Furthermore, some exercisers, patients, or other persons may prefer to use the aquatic leg section without an internal shin pad.

The shin deflector 28 and leg fins of the aquatic leg section 22 define water-resistant impingement surfaces and solid barriers which are substantially imperforate except for leg strap-receiving holes, openings or apertures in the middle of rearward apexes of the forwardly facing V-shaped pockets 45–48. The holes receive a flexible leg strap or belt 82 (FIG. 3) with a D-ring or Velcro type end portions which matingly engage and attach each other. The leg strap 82 ties around the clam shell 90 or the calf (back) of the leg. The leg strap 82 can alternatively have a buckle, latch or other fastening member or device to detachably tighten, secure, loosen, or untie the leg strap 82. In some circumstances, it may be desirably that more or fewer leg straps be used. Furthermore, the leg strap-receiving holes can be omitted if the leg strap is glued or fastened to the rearward portions of the leg fins.

Figure 2:
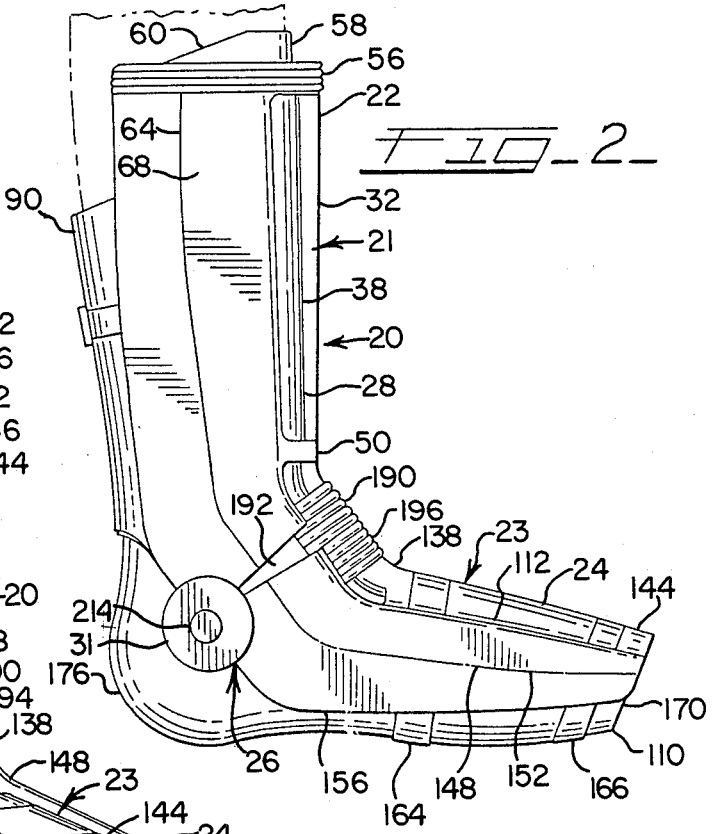
FIG. 2 is a left side view of the aquatic boot.
Figure 3:
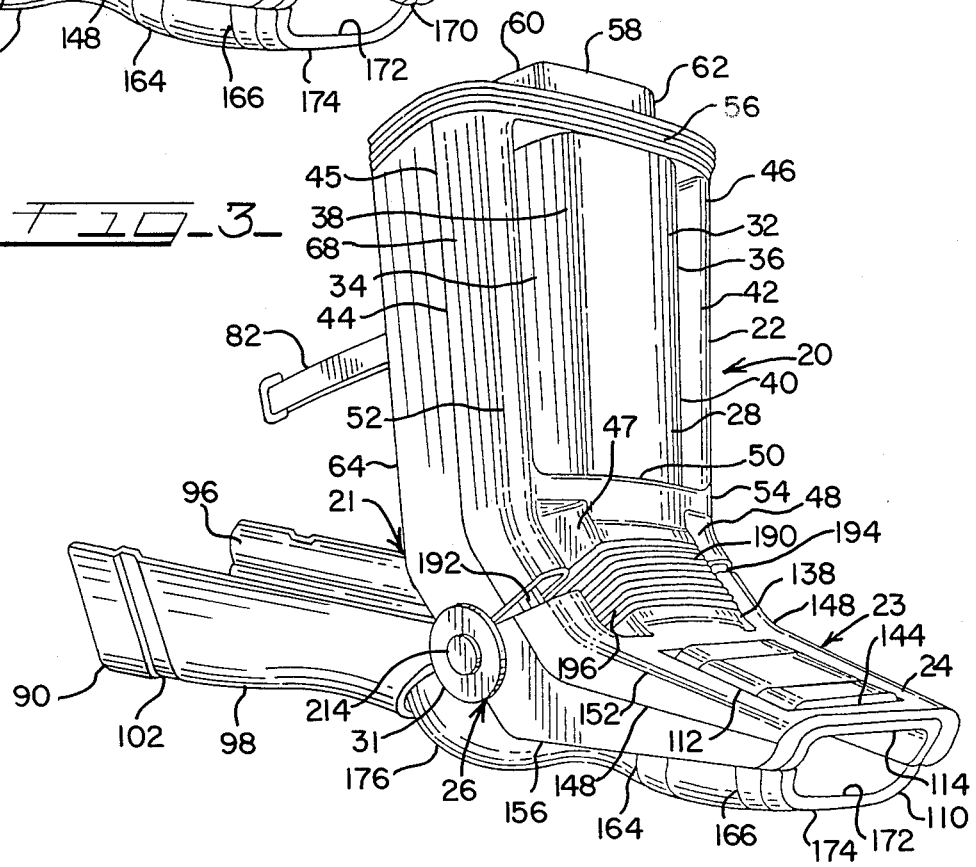
FIG. 3 is a perspective view of the aquatic boot with the calf-engaging portion in an open position.
Figure 7:
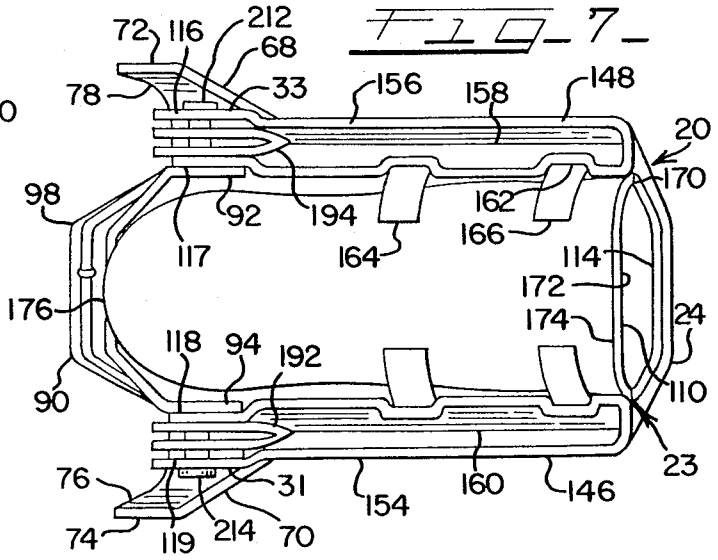
FIG. 7 is a bottom view of the aquatic boot.
Figure 10:
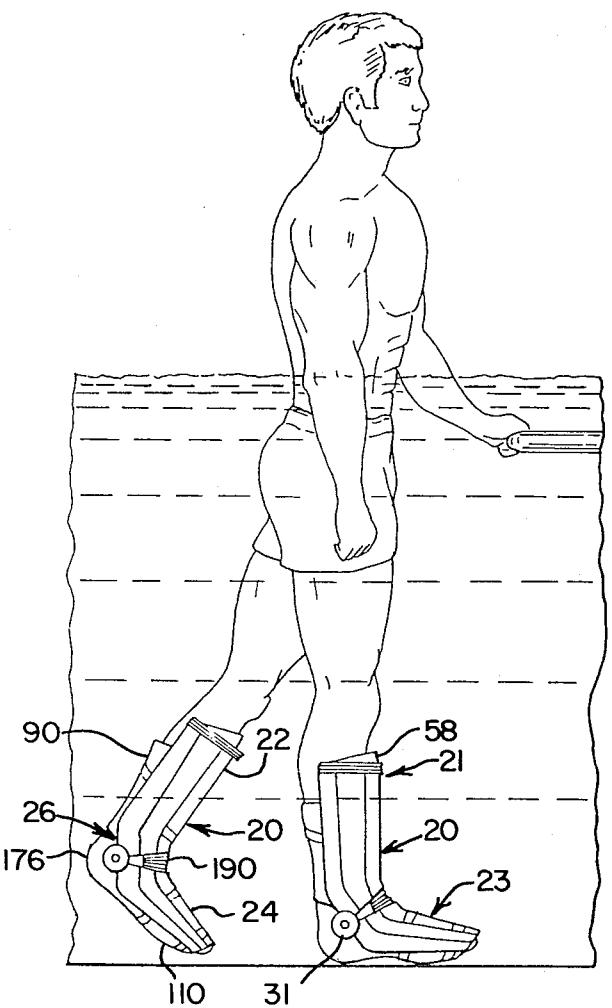
FIG. 10 is a view of a person using a pair of aquatic boots.

As shown in FIGS. 1–3, the aquatic leg assembly comprises an aquatic leg section 22 and an aquatic water-resistive, calf-engaging, generally imperforate, rigid clam shell 90. The calf-engaging clam shell 90 provides a curved, U-shaped or channel-shaped, aquatic calf portion which snugly fits against, abuttingly engages, and generally conforms to the calf of the person's legs. The bottom portions of the aquatic calf portion 90 is pivotally connected to the bottom portions (shin discs 25, 27, 31, and 33) of the aquatic leg section 22 via pivotable, symmetrical, annular, circular calf discs 92 and 94 (FIGS. 5 and 7). The aquatic calf portion is moveable (pivotable) from an open position as shown in FIG. 3, when inserting and removing the person's leg into the aquatic boot 20, to a closed position as shown in FIG. 10, when hydrodynamically moving and using the aquatic boot 20 in the water.

The aquatic calf portion (clam shell) 90 has a forwardly facing, concave, U-shaped or channel-shaped, inner calf surface 96 (FIG. 3) and an rearwardly facing, convex, U-shaped or channel-shaped, outer calf surface 98. The inner calf surface 96 can have forwardly facing, horizontal, arcuate calf ribs to enhance the structural strength and rigidity of the calf portion 90. An elastomeric, ribbed, inner calf pad (padding) 100 (FIG. 5) can be positioned against the inner calf surface 96. The calf pad 100 provides a vibration dampening calf cushion and can be made of an elastomeric rubber-like material, such as neoprene rubber, which resiliently conforms to and matingly engages the back (calf) of the person's leg. Other pad materials can be used.

The outer calf surface 98 (FIG. 3) provides a water-resistive calf barrier to, enhance the rearward pressure head and fluid resistance as the aquatic calf portion 90 is moved rearwardly. The outer calf surface 98 can have an indented strap-supporting, arcuate section or channel 102 to support and engage the leg straps 82.

The aquatic calf portion 90 help distribute aquatic load and pressures and provides a more secure and comfortable fit than the use of a strap(s) alone without a clam shell. The clam shell 90 can be made of the same material as the leg section 22 and is shorter than the leg section 22. Other rigid water-impervious materials can be used while the illustrative embodiment is preferred, in some circumstances it may be desirable that the clam shell be perforated (foraminous), flexible, or of a different size and shape.

Figure 14:
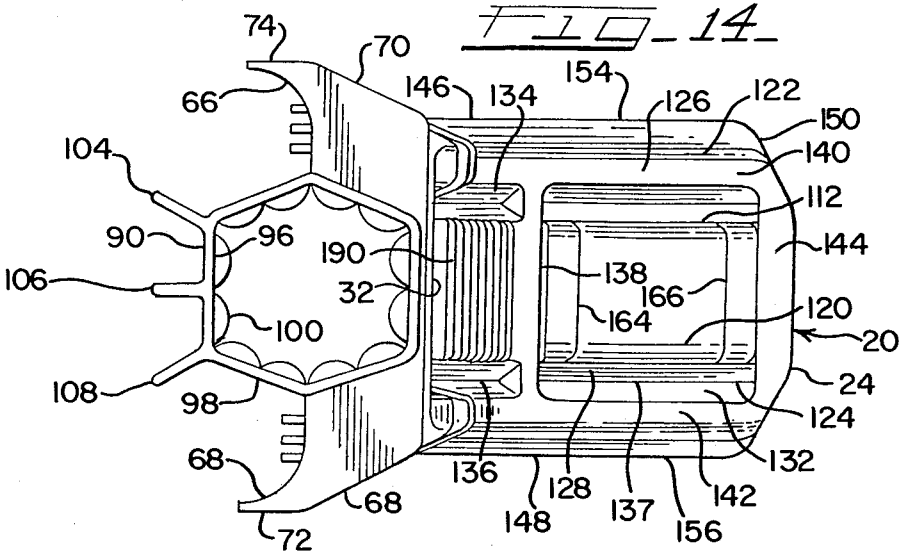
FIG. 14 is a top view of an aquatic boot with calf fins.

The aquatic calf portion (clam shell) 90 (FIG. 14) can have rearwardly extending, rigid upright, water-resistive calf expansion fins 104, 106 and 108 to enhance the transverse fluid resistance and pressure head as the aquatic calf portion is moved sideways. In the embodiment of FIG. 14, the calf fins include an intermediate central calf fin 106 and outwardly diverging flared calf fins 104 and 108 which extend outwardly from about 30 degrees to about 60 degrees, and preferred by about 45 degrees. The illustrated calf fins 104, 106 and 108 are the same height, planar and flat and slope downwardly a substantial length of the calf portion 90. The calf fins can have a triangular shape as viewed from the side. The horizontal strap supporting portion provides a horizontal channel which extends through the calf fins. In some circumstances it may be desirable that more or less calf fins be used or that the calf fins be flexible or of a different height or shape.

The aquatic foot assembly 21 (FIGS. 1–4) has an aquatic foot section 24 and an aquatic flexible composite sole 110. The aquatic foot section 24 has an outer, external, generally U-shaped or channel-shaped, water-engageable foot deflector or baffle 112 with an internal generally U-shaped or channel-shaped, elastomeric ribbed, inner foot pad (padding) 114 which provides a vibration dampening foot cushion. The left and right (inner and outer) bottom portions of the aquatic foot section 24 includes connectable, pivotable, symmetrical, annular circular foot discs 116–119 (FIGS. 5 and 7) which are pivotally connected to the calf discs 92 and 94 and the leg discs 25, 27, 31, and 33. The aquatic foot section 24 can also have downwardly facing, arcuate foot ribs to enhance the structural strength and rigidity of the foot section 24. The internal foot pad 114 is made of an elastomeric rubber-like cellular foam material, such as closed cell neoprene rubber, that resiliently conforms to and matingly engages the top of the foot. Other materials can be used.

The foot deflector 112 (FIG. 6) has a generally planar or flat, upwardly facing, front foot face 120, plate or bight and generally V-shaped flared sides 122 and 124 which extend downwardly from the ends of the front foot face 120. The V-shaped sides 122 and 124 have generally planar or flat inner foot fins 126 and 128 which extend downwardly and outwardly from the ends of the front foot face 120 at an obtuse angle ranging from about 105 degrees to about 165 degrees, preferably about 120 degrees to about 150 degrees. Generally planar or flat inner foot sides 130 and 132 extend upwardly and outwardly, from the rearward end of the inner foot fins 126 and 128, respectively, at an acute angle ranging from about 30 degrees to about 75 degrees, preferably about 60 degrees, and provide inclined upwardly extending foot fins. The V-shaped sides 122 and 124 provide front and back upwardly facing, V-shaped foot pockets 134–137 or cups to cuppingly and resistively engage the water as the aquatic foot section 24 is moved in a upward direction in the water. The V-shaped foot pockets 134–137 are separated by a horizontal transverse, water-resistive, upwardly facing, generally planar or flat, inverted T-shaped front crossbar 138. The front crossbar 138 extends horizontally between and connects the upwardly facing, rearwardly diverging, peripheral foot sides 140 and 142. A front horizontal stabilizing crossbar 144 extends across the front of the peripheral foot sides 140 and 142. The crossbars 138 and 144 enhance the upward water resistance and aquatic stability of the foot section 24.

Outer foot fins or wings 146 and 148 extend outwardly and downwardly of the peripheral foot sides 140 and 142. The outer foot fins 146 and 148 include inclined lateral foot fins 150 and 152 and transverse foot fins or side fins 154 and 156. The lateral foot fins 150 and 152 extend downwardly and outwardly from the ends of the peripheral foot sides 140 and 142 at an obtuse angle ranging from about 105 degrees to about 165 degrees, preferably about 120 degrees to about 150 degrees. The transverse foot fins 154 and 156 extend downwardly at an angle ranging from about 195 degrees to about 265 degrees from the bottom of the lateral foot fins 150 and 152. The transverse foot fins 154 and 156 can be positioned perpendicular or normal to front foot face 120.

The downwardly facing, bottom surfaces of the lateral foot fins 150 and 152 cooperate with the downwardly facing bottom surfaces of the transverse foot fins 154 and 156, respectively, to define rearwardly facing, arcuate concave or V-shaped, foot pockets 158 and 160 (FIG. 7) or cups which cuppingly and resistively engage the water as the aquatic foot section 24 is moved downwardly through the water. The transverse foot fins 154 and 156 also provide water-resistive transverse end portions or side portions and surfaces that resistively engage the water as the aquatic foot section 24 is moved sideways through the water. The lateral foot fins 150 and 152 (FIG. 6) and the transverse foot fins 154 and 156 can be generally planar or flat. The outer foot fins 146 and 148 can have downwardly facing, horizontal arcuate ribs for enhanced structural strength and rigidity. The transverse side fins 154 and 156 extend laterally outwardly in a sideways direction from the front foot face 120 of the aquatic foot section 24 and are substantially rigid to provide an effective hydrodynamic force, torque and pressure head. The rearward extremities of the transverse foot fins 154 and 156 are aligned With each other. The corners or junction where the foot fins intersect each other or the peripheral foot sides of the foot deflector can be rounded and curved.

The foot fins are preferably imperforate. The foot fins provide increased surface area to effectively resist movement through the water. The foot fins provide hydrodynamic resistance foot assemblies which hydrodynamically deflect water and create a pressure head and fluid resistance to water flow as the aquatic foot section 24 is moved through the water. The foot fins are positioned an effective distance from front foot face 120 to exert a hydrodynamic torque on the front foot face 120 and foot to strengthen the muscles of the person's leg.

While the front foot deflector 112 and foot fins of the aquatic foot section 24 are preferable shaped and proportioned as shown in the drawings and described above for best results, in some circumstances it may be desirable that the front foot deflector and the foot fins be flexible, curved, proportioned differently, at different angular relationships, or of a different shape, or that more or less fins be used. Furthermore, some exercisers, patients, or other persons may prefer to use the aquatic foot section without an internal foot pad.

The front foot deflector 112 and foot fins of the aquatic foot section 24 define water-resistant impingement surfaces and solid barriers which are substantially imperforate except for foot strap-receiving holes 162 (FIG. 7), openings or apertures in the upwardly facing V-shaped pockets 158 and 160. The holes receive a flexible foot straps or belts 164 and 166 with Velcro type end portions which matingly engage and attach each other. The foot straps 164 and 166 tie around the aquatic sole 110 or sock. Alternatively, the foot straps can have a D-ring, buckle, latch or other fastening member or device to detachably tighten, secure, loosen, or untie the foot straps. In some circumstances, it may be desirably that more or fewer foot straps be used. Furthermore, the foot strap-receiving holes can be omitted if the foot straps 146 and 148 are glued or otherwise fastened to the downward portions of the foot fins.

An aquatic flexible composite sole 110 extends downwardly from and is sewn, bonded, fastened or otherwise secured connected the inner and outer (left and right) lower portions of the foot deflector 112 of the foot section 24. The aquatic sole 110 abuts against and is in arcuate alignment and registration with the inner foot pad 114. The aquatic sole 110 and foot pad 114 annularly surround, generally conform to, and snugly engage the person's foot. The aquatic sole 110 and aquatic foot section 24 are open ended at their front end to provide an open toe portion 170 to more readily accommodate different size feet. The aquatic sole 110 spans about the same length as the aquatic foot section 24 so that the forward edges and tips of the aquatic sole 110 and leg section 24 are in substantial vertical alignment. While the illustrated embodiment is preferred for best results, in some circumstances it may be desirable that the aquatic sole and aquatic foot section have different lengths or have a closed toe portion or that the aquatic sole be annular and provide an aquatic sock.

The aquatic sole 110 is curved, and concave. The aquatic sole has a concave inner surface 172 (FIGS. 1 and 3) and a convex outer surface 174 that extends from abort 120 degrees to 360 degrees, preferably about 180 degrees. The aquatic sole 110 preferably has a semi-circular cross section. While the illustrated aquatic sole is preferred for best results, other aquatic soles can be used.

The aquatic sole 110 has a flexible rounded heel portion 176 which snugly engages and generally conforms to the person's heel. The heel portion 176 is sewn, bonded, fastened, or otherwise connected to the lower end of the foot deflector 100. A supplemental heel strap or belt 178 (FIG. 5) is sewn, bonded, or otherwise connected to the heel portion 176. The heel strap 170 can extend through a heel strap-receiving opening 180 in the calf-engaging clam shell 90 to connect the clam shell 90 to aquatic heel portion 176. The heel strap 178 can have Velcro type end portions which matingly engage and attach to each other. Alternatively, the heel strap can have a latch, buckle, or other fastening member to detachably tighten, secure, loosen or untie the strap. The foot straps 164 and 166 (FIG. 7) are sewn, bonded, or otherwise attached to the bottom of the aquatic sole 110.

The composite aquatic sole 110 has an inner elastomeric resilient core 181 (FIG. 4), an upwardly facing inner Terry type cloth lining 182, and a downwardly facing, hardened rubberized, outer coating 184. The core 181 is made of a flexible elastomeric material, such as neoprene. Other materials can be used. The cloth lining 182 provides a soft engagement surface which fits upon and against the bottom of the person's foot and the person's heel. The rubberized outer coating 184 helps minimize and prevent wear when the aquatic boot steps on, rubs against, and engages the bottom of a swimming pool or the sandy or stony bottom of a pond, lake, river, or other body of water. While the illustrated composite sole 110 is preferred for best results, in some circumstances it may be desirable that the aquatic sole have more or fewer layers or be made of different materials.

Figure 12:
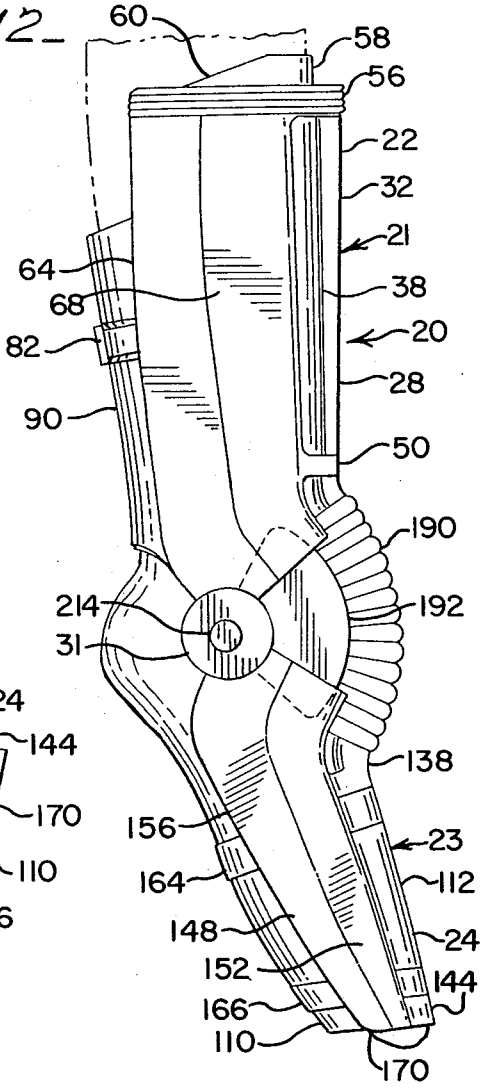
FIG. 12 is a side view of the aquatic boot in an expanded open position.
Figure 11:
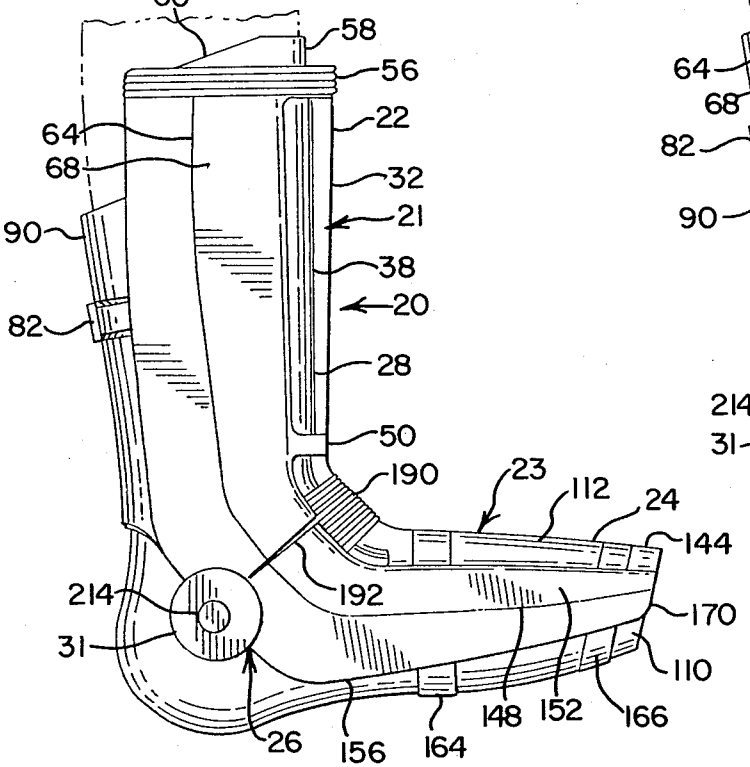
FIG. 11 is a side view of the aquatic boot in a retracted closed position.

The multi-piece ankle section 26 comprises a resilient upwardly facing, water-resistive, arcuate expansion joint 190 and pivotable, water-resistant, transversely facing side ankle fins 192 and 194 (FIGS. 5 and 7). The multi-piece ankle section 26 permits the aquatic leg assembly 21 and the aquatic foot assembly 23 to move from an closed retracted, forward walking position as shown in FIG. 11 to an open expanded, toe pointing, stretching position as shown in FIG. 12 as well as positions in between.

The expansion joint 190 (FIGS. 2 and 3) comprises flexible accordion type zigzag integral hinges 196 which are bonded, fastened or otherwise securely connected to the bottom portion of the front shin face 32 of the leg section 22 and the rearward portion of the upper face 112 of the aquatic foot section 24. Bonding can be by marine adhesive, epoxy resin, or glue. The hinged expansion joint 190 flexibly extends between and hingeably connects the leg section 22 and the foot section 24 to accommodate pivotable movement of the leg and foot sections. The expansion joint 190 fits over, generally conforms to and covers the top of the person's ankle. Desirably, the accordion style zigzag hinges 196 provide an upwardly facing hydrodynamic resistance assembly for blocking downward flow of water between the leg section 22 and the foot section 24 and provide auxiliary upward fluid resistance 190 and pressure head as the aquatic boot 20 and expansion joint 190 are moved upwardly in the water. The expansion joint 190 can be made of a flexible water-resistant material, such as elastic, metal, rubber, rubberized fabric or other elastomeric material. While the illustrated expansion joint is preferred for best results, in some circumstances it may be desirable to use another type of expansion joint.

Figure 8:
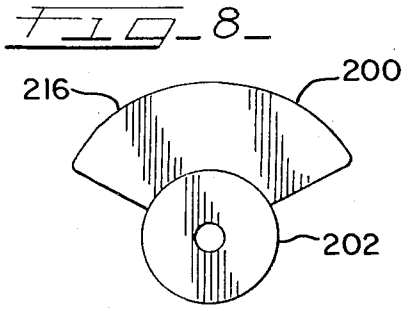
FIG. 8 is a side view of an ankle fin.

The multi-piece ankle section 26 also includes a parallel pair of symmetric ankle side fins 192 and 194 (FIGS. 5 and 7). The ankle fins 192 and 194 extend laterally between and pivotally connect the bottom side portions of the leg section 22 to the upper side portions of the foot section 24. Each of the ankle fins 192 and 194 have at least one arcuate side portion 200 (FIG. 8) and at least one arcuate pivot (pivotable) portion 202. The arcuate side portion 200 provides a water-resistive side barrier which slides upon the inner bottom side portions of the leg section 22 and the inner upper side portions of the foot section 24. The water-resistive side barriers slidably fit against and cover the sides of the person's foot and block transverse flow of water between the leg section and the foot section. The pivot portion 202 provides a hinge and pivot point which pivotally connect the arcuate side portion 200 to the leg and foot sections 22 and 24.

Figure 9:
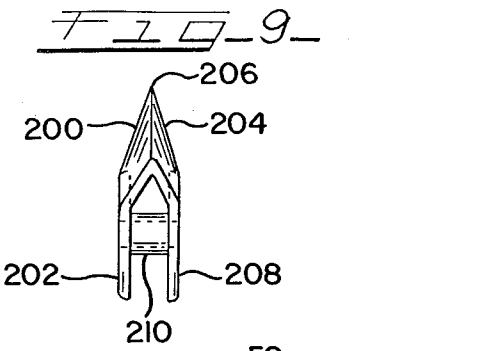
FIG. 9 is a back view of the ankle fin.

As shown in FIG. 9, each of the ankle fins 192 and 194 can have a generally A-shaped cross section as viewed from the rear. The A-shaped ankle fins 192 and 194 have inner and outer, upwardly converging, flared, arcuate side portions 200 and 204 which are connected along their top or apex 206 and have inner and outer (left and right) parallel annular circular ankle discs 202 and 208. A lateral tubular shaft 210 extends transversely between and connects the bottom part of the arcuate side portions 200 and 204. The annular ankle discs 202 and 208 and shaft 210 receive one of the pivot pins 212 and 214 (FIG. 5), cotter pins or bolts.

In FIGS. 1–7, the ankle fins 192 and 194 are separate individual components which are connected to the leg section 22 and the foot section 24 by the pivot pins 212 and 214. The outer shin (leg) disc can fit upon, matingly engage and be positioned outwardly of the outer ankle disc. The outer foot disc can fit upon, matingly engage and be positioned outwardly of the shin (leg) disc. The inner shin (leg) disc can fit upon, matingly engage and be positioned inwardly of the inner ankle disc. The inner foot disc can fit upon, matingly engage and be positioned inwardly of the shin (leg) disc. The calf disc can fit upon, matingly engage and be positioned inwardly of the inner foot disc. The discs accommodate pivotable movement of the leg and foot sections so that the leg section can be positioned forwardly at an acute angle with the foot section when the person is stepping forwardly as in FIG. 11 and so that the foot section can be aligned with the leg section when the person's foot and leg are in a stretched out position as in FIG. 12, as well as accommodating positions therebetween. In some circumstances, it may be desirable that some of the discs be an integral unit or that fewer discs be used or that the discs have a different shape.

Figure 13:
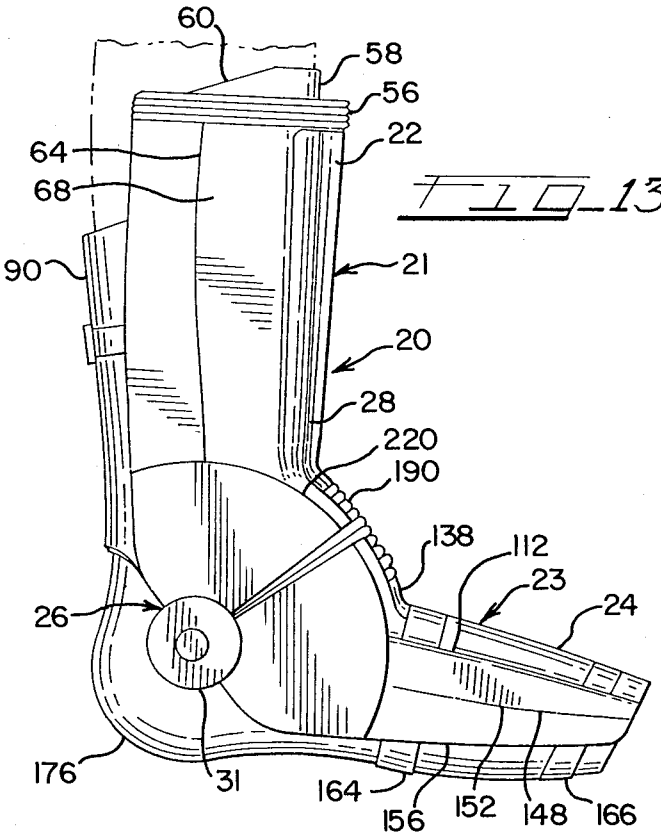
FIG. 13 is a side view of an aquatic boot with a partial circular ankle fin.

The arcuate side portions 200 and 204 (FIG. 9) of the ankle fins 192 and 194 are planar, flat, and imperforate and have a convex curved upper surface 216 (FIG. 8) which extends from about 15 degrees to about 75 degrees, preferably from about 30 degrees to about 60 degrees. The arcuate side portions can also comprise external partially circular portions or segments 220 as shown in FIG. 13. The partially circular portions or segments 220 (FIG. 13) can extend from about 75 degrees to about 240 degrees, preferably from about 150 degrees to about 210 degrees.

The ankle fins 192 and 194 are rigid and made of the same material as the aquatic leg section 22 and foot section 24. While the illustrated ankle fins are preferred for excellent results, in some circumstance it may be desirable that the ankle fins be flexible or made of a different water-resistive material, or that the side portions and pivot portions have a different configuration. Furthermore, it may be desirable in some circumstances that the ankle fins have a different shaped cross section or that only a single arcuate side portion and a single pivot portion (disc) be used in each ankle fin.

Figure 15:
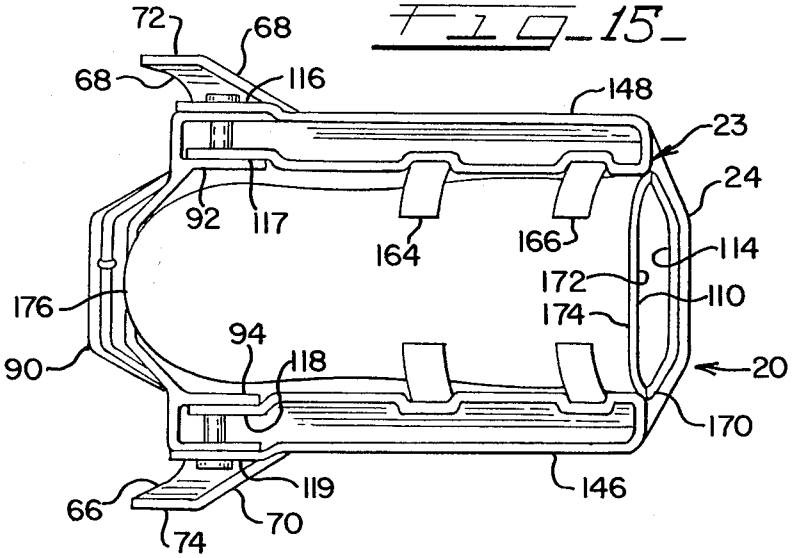
FIG. 15 is a top view of an aquatic boot with integral discs.

In the embodiment of FIG. 15, the ankle fins are integrally connected and molded to the clam shell (calf portion) 90 and have integral unitary discs (pivot portions) therewith. Alternatively, the ankle fins can also be integrally molded to the leg section 22 or to the foot section 24 and have integral unitary discs (pivot portions) therewith. If desired, the ankle fins and the expansion joint can have an internal elastomeric lining or pad.

It can, therefore, be seen that each of the fins of the aquatic boot 20 have outer, generally imperforate, water-impingement surfaces which increase hydrodynamic resistance of water flow as the aquatic exercise boot 20 is moved through the water. The water resistance (resistive forces) exerted by the fins of the aquatic exercise boot 20 as the aquatic boot 20 is moved in the water can be increased by increasing the span, length, transverse width, or height of the fins thereby enlarging the effective cross-sectional area that is positioned generally normal to the direction of movement of the aquatic boot 20.

The fins of the aquatic boot 20 are rigid and are made of similar materials. While the illustrated embodiment is preferred for best results, in some circumstances it may be desirable that the fins be flexible, curved, foraminous (perforated), or have a different configuration or that more or less fins be used. One or more of the fins can be made of fabric, and/or be expandable or moveable, and/or comprise parachute style fins, balloon like fins, sail fins, or bellows type fins. Furthermore, in some circumstances it may be desirable that the pockets have fluid flow passageways, holes, or apertures.

The padding (pads) can be snugly positioned against or securely connected to the leg and foot assemblies. The padding can also be releasably attached to the leg and foot assemblies, such as with Velcro type fasteners. Different layers of padding can also be used.

Some users may prefer to omit the leg assembly or the foot assembly or use parts of the leg, ankle, and/or foot assemblies.

The aquatic exercise boot 20 provides a wider range of movement in the water with less stress on the joints of the user than is attainable with most types of conventional exercise devices that are used on land and offers many advantages to physical therapists. The aquatic exercise boot 20 also provides more water-resistive surface area and attains greater fluid resistance than larger conventional exercise devices.

Among the many advantages of the novel aquatic boot are:

1. Superior fluid resistance.
2. Outstanding hydrodynamics.

3. Improved aquatic exerciser.
4. Enhanced capability for physical therapy.
5. Greater ranges of aquatic exercises.
6. Quicker and more fuller strength development.
7. Better exercise workout in water.
8. Excellent structural strength and integrity.
9. Attractive.
10. Simple to use.
11. Safe.
12. Convenient.
13. Comfortable.
14. Portable.
15. Compact.
16. Economical.
17. Reliable.
18. Efficient.
19. Effective.

Although embodiments of the invention has been shown and described, it is to be understood that various modifications and substitutions, as well as rearrangements of parts, can be made by those skilled in the art without departing from the novel spirit and scope of this invention.

What is claimed:

1. An aquatic boot for use in water to strengthen muscles, improve muscle tone and enhance muscular coordination, comprising:

an aquatic leg assembly comprising an aquatic leg section and a pivotable calf-engaging shell;

an aquatic foot assembly comprising an aquatic foot section and an aquatic flexible, concave composite sole; and an aquatic ankle assembly pivotally connecting said aquatic leg assembly to said aquatic foot assembly, said aquatic ankle assembly comprising pivotable, upright water-resistive ankle fins and a resilient upwardly facing, water-resistive expansion joint;

said aquatic leg section comprising a composite shin portion for snugly engaging, fitting against, generally conforming to the shin and lower front portion of a person's lower leg;

a water-engageable shin deflector with a water resistant forwardly facing front face and a pair of generally V-shaped shin sides extending generally rearwardly from said forward facing front face;

an inner elastomeric shin pad positioned inwardly of and engaging said shin deflector;

said V-shaped shin sides comprising inner leg fins and forwardly extending leg fins, said inner leg fins extending generally rearwardly and outwardly from said forwardly facing front face, said forwardly extending leg fins extending generally forwardly and outwardly from said inner leg fins;

said inner leg fins and forwardly extending leg fins cooperating with each other to define forwardly facing, generally V-shaped pockets for cuppingly and resistively engaging the water as said aquatic leg section is moved forwardly through the water;

each of said leg fins and said forwardly facing front face having substantially imperforate water-impervious portions defining water-resistive impingement surfaces for hydrodynamically deflecting water and creating a forward pressure head and fluid resistance to water flow as said aquatic leg section is moved forwardly through the water;

peripheral leg sides and outer leg fins extending generally rearwardly and outwardly of said peripheral leg sides;

said outer leg fins including lateral leg fins and transverse leg fins, said lateral leg fins extending generally rearwardly and outwardly from said peripheral leg sides, said transverse leg fins extending generally rearwardly from said lateral leg fins; and said outer leg fins defining generally rearwardly facing pockets for cuppingly and resistively engaging the water as said aquatic leg section is moved rearwardly in the water;

said aquatic foot section comprising an aquatic composite member for snugly engaging, fitting upon, and generally conforming to a top portion of the person's foot;

a water-engageable foot deflector with a water resistant upwardly facing front face and a pair of generally V-shaped foot sides extending generally downwardly from said upwardly facing front face;

an inner elastomeric foot pad positioned inwardly of and engaging said foot deflector;

said V-shaped foot sides comprising inner foot fins and upwardly extending foot fins, said inner foot fins extending generally downwardly and outwardly from said upwardly facing front face, said upwardly extending foot fins extending generally upwardly and outwardly from said inner foot fins;

said inner foot fins and upwardly extending foot fins cooperating with each other to define upwardly facing generally V-shaped pockets for cuppingly and resistively engaging the water as said aquatic foot section is moved upwardly through the water;

each of said foot fins and said upwardly facing front face having substantially imperforate water-impervious portions defining water-resistive impingement surfaces for hydrodynamically deflecting water and creating an upward pressure head and fluid resistance to water flow as said aquatic foot section is moved upwardly through the water;

peripheral foot sides and outer foot fins extending generally downwardly and outwardly of said peripheral foot sides;

said outer foot fins including lateral foot fins and transverse foot fins, said lateral foot fins extending generally downwardly and outwardly from said peripheral foot sides, said transverse foot fins extending generally downwardly from said lateral foot fins; and said outer foot fins defining generally downwardly facing arcuate pockets for cuppingly and resistively engaging the water as said aquatic foot section is moved downwardly in the water;

said ankle fins extending laterally between and pivotally connecting said foot section to said leg section, said ankle fins slidably positioned relative to at least one of said sections, said ankle fins having arcuate side portions for covering the sides of the person's ankle and pivotable annular discs, said ankle fins providing a water-resistant barrier for substantially preventing water from passing transversely between said foot section and said leg section;

said expansion joint comprising flexible accordion type hinges, said hinges generally covering the top of the person's ankle and flexibly extending between and hingeably connecting said leg section and said foot section for accommodating pivotable movement of said leg and foot sections, said water-resistive expansion joint providing an upwardly facing hydrodynamic resistance assembly for blocking downward flow of water between said leg section and said foot section and providing auxiliary upward fluid resistance and pressure head as said aquatic boot is moved upwardly in the water;

said aquatic concave, flexible composite sole connected to and extending downwardly from aquatic foot section, said aquatic sole having a rounded heal portion connected to said aquatic foot section for receiving the person's heel and having a front portion spaced below said aquatic foot section, said aquatic sole cooperating with said internal pad of said aquatic foot section to provide an open toe aquatic sock, said composite sole having an elastomeric core, an upwardly facing cloth lining, and a downwardly facing hardened rubberized coating for minimizing wear when said aquatic boot rubs against, steps upon, and engages the bottom of a swimming pool or the sandy or stony bottom of the water, and straps connected to said aquatic sole for attachably engaging said aquatic foot section;

said calf-engaging shell comprising an aquatic substantially rigid, concave calf portion providing a substantially imperforate pivotable shell for snugly fitting against, abuttingly engaging, and generally conforming to the calf of the persons legs, said calf portion pivotally connected to said ankle portion and moveable from an open position when inserting or removing the person's leg from the aquatic boot to a closed position when hydrodynamically moving and using said aquatic boot, said aquatic calf portion having an inner elastomeric calf padding, and fastening means for securing said aquatic calf portion to said aquatic leg section in said closed position; and said fins being positioned an effective distance from said front faces and comprising hydrodynamic resistance assemblies for exerting a hydrodynamic torque on the leg, ankle and foot to strengthen the muscles of the leg, ankle and foot as said aquatic boot is moved through the water.

2. An aquatic boot in accordance with claim 1 wherein said concave sole is substantially semi-circular and said leg section has an upper arcuate water-engageable flange.

3. An aquatic boot in accordance with claim 1 wherein said calf portion has rearward fins and said fastening means comprise a strap.

4. An aquatic boot for use in water to strengthen muscles, improve muscle tone and enhance muscular coordination, comprising:

an aquatic foot assembly comprising an aquatic foot section for fitting over and generally conforming to a top portion of a person's foot; and an aquatic flexible concave composite sole connected to said foot section for fitting under, engaging against, and covering a substantial portion of the sole of the person's foot;

said aquatic foot section comprising an aquatic composite member for snugly engaging, fitting upon, and generally conforming to a top portion of the person's foot;

a water-engageable foot deflector with a water resistant upwardly facing front face and a pair of generally V-shaped foot sides extending generally downwardly from said upwardly facing front face;

an inner elastomeric foot pad positioned inwardly of an engaging said foot deflector;

said V-shaped foot sides comprising inner foot fins and upwardly extending foot fins, said inner foot fins extending generally downwardly and outwardly from said upwardly facing front face, said upwardly extending foot fins extending generally upwardly and outwardly from said inner foot fins;

said inner foot fins and upwardly extending foot fins cooperating with each other to define upwardly facing, generally V-shaped pockets for cuppingly and resistively engaging the water as said aquatic foot section is moved upwardly through the water;

each of said foot fins and said upwardly facing front face having substantially imperforate water-impervious portions defining water-resistive impingement surfaces for hydrodynamically deflecting water and creating an upward pressure head and fluid resistance to water flow as said aquatic foot section is moved upwardly through the water;

peripheral foot sides and outer foot fins extending generally downwardly and outwardly of said peripheral foot sides;

said outer foot fins including lateral foot fins and transverse foot fins, said lateral foot fins extending generally downwardly and outwardly from said peripheral foot sides, said transverse foot fins extending generally downwardly from said lateral foot fins;

said outer foot fins defining generally downwardly facing arcuate pockets for cuppingly and resistively engaging the water as said aquatic foot section is moved downwardly in the water; and said fins being substantially stationary and rigid and positioned an effective distance from said front face and comprising hydrodynamic resistance assemblies for exerting a hydrodynamic torque on the foot to strengthen the muscles of the foot as said aquatic boot is moved through the water; and said aquatic concave, flexible composite sole connected to and extending downwardly from aquatic foot section, said aquatic sole having a rounded heal portion connected to said aquatic foot section for receiving the person's heel and having a front portion spaced below said aquatic foot section, said aquatic sole cooperating with said internal pad of said aquatic foot section to provide an open toe aquatic sock, said composite sole having an elastomeric core, an upwardly facing cloth lining, and a downwardly facing hardened rubberized coating for minimizing wear when said aquatic boot rubs against, steps upon, and engages the bottom of a swimming pool or the sandy or stony bottom of the water, and straps connected to said aquatic sole for attachably engaging said aquatic foot section.

5. An aquatic boot for use in water to strengthen muscles, improve muscle tone and enhance muscular coordination, comprising:

an aquatic leg assembly comprising an aquatic leg section for fitting over and generally conforming to the front portion of a person's lower leg; and a calf-engaging shell pivotably connected to said leg section for fitting against, engaging, and generally conforming to the calf of the person's leg;

said aquatic leg section comprising a composite shin portion for snugly engaging, fitting against, and generally conforming to the shin and lower front portion of a person's lower leg;

a water-engageable shin deflector with a water resistant forwardly facing front face and a pair of generally V-shaped shin sides extending generally rearwardly from said forward facing front face;

an inner elastomeric shin pad positioned inwardly of an engaging said shin deflector;

said V-shaped shin sides comprising inner leg fins and forwardly extending leg fins, said inner leg fins extending generally rearwardly and outwardly from said forwardly facing front face, said forwardly extending leg fins extending generally forwardly and outwardly from said inner leg fins;

said inner leg fins and forwardly extending leg fins cooperating with each other to define forwardly facing, generally V-shaped pockets for cuppingly and resistively engaging the water as said aquatic leg section is moved forwardly through the water;

each of said leg fins and said forwardly facing front face having substantially imperforate water-impervious portions defining water-resistive impingement surfaces for hydrodynamically deflecting water and creating a forward pressure head and fluid resistance to water flow as said aquatic leg section is moved forwardly through the water;

peripheral leg sides and outer leg fins extending generally rearwardly and outwardly of said peripheral leg sides;

said outer leg fins including lateral leg fins and transverse leg fins, said lateral leg fins extending generally rearwardly and outwardly from said peripheral leg sides, said transverse leg fins extending generally rearwardly from said lateral leg fins;

said outer leg fins defining generally rearwardly facing pockets for cuppingly and resistively engaging the water as said aquatic leg section is moved rearwardly in the water; and said fins being substantially rigid and stationary and positioned an effective distance from said front face and comprising hydrodynamic resistance assemblies for exerting a hydrodynamic torque on the leg to strengthen the muscles of the leg as said aquatic boot is moved through the water; and said calf-engaging shell comprising an aquatic substantially rigid, concave calf portion providing a substantially imperforate pivotable shell for snugly fitting, abuttingly engaging, complementing, and positioned along the calf of the person's leg, said calf portion being moveable from an open position when inserting or removing the person's leg from the aquatic boot to a closed position when hydrodynamic moving and using said aquatic boot, said aquatic calf portion having an inner elastomeric calf padding, and fastening means for securing said aquatic calf portion to said aquatic leg section in said closed position.

* * * * *